US006559826B1

(12) United States Patent
Mendelson et al.

(10) Patent No.: US 6,559,826 B1
(45) Date of Patent: May 6, 2003

(54) METHOD FOR MODELING AND UPDATING A COLORIMETRIC REFERENCE PROFILE FOR A FLAT PANEL DISPLAY

(75) Inventors: Jonathan Mendelson, Mountain View, CA (US); Daniel E. Evanicky, San Jose, CA (US)

(73) Assignee: Silicon Graphics, Inc., Mountain View, CA (US)

( * ) Notice: Subject to any disclaimer, the term of this patent is extended or adjusted under 35 U.S.C. 154(b) by 0 days.

(21) Appl. No.: 09/502,555

(22) Filed: Feb. 10, 2000

Related U.S. Application Data

(63) Continuation-in-part of application No. 09/187,161, filed on Nov. 6, 1998, now abandoned.
(60) Provisional application No. 60/171,017, filed on Dec. 15, 1999.

(51) Int. Cl.[7] ..... G09G 3/36
(52) U.S. Cl. ..... 345/102; 345/207; 345/208
(58) Field of Search ..... 345/150, 102, 345/154, 207, 208, 88

(56) References Cited

U.S. PATENT DOCUMENTS 5,293,224 A * 3/1994 Ajima ..... 348/656
5,315,378 A * 5/1994 Satou et al. ..... 348/655
6,129,444 A * 10/2000 Tognoni ..... 362/295
6,181,391 B1 * 1/2001 Okita et al. ..... 349/65

OTHER PUBLICATIONS

IBM Technical Disclosure Bulletin vol. 37 No. 11 Nov. 1994 p. 425–426.*

* cited by examiner

*Primary Examiner*—Richard Hjerpe
*Assistant Examiner*—Kevin M. Nguyen
(74) *Attorney, Agent, or Firm*—Baker Botts L.L.P.

(57) ABSTRACT

A method and system for updating the colorimetric characteristics of a flat panel display over the display's entire lifetime. An advantage of the present invention is that the useful life and the color accuracy of a flat panel display can be extended. In one embodiment of the invention, an initial set of luminance data of a flat panel monitor is programmed into addressable memory locations within that monitor. Thereafter, the luminance output of the lamps of the flat panel monitor is tracked with luminance or colorimetric measuring devices. According to the present invention, the luminance data are used in determining the correlation between voltage settings of the lamps and the color characteristics of the display such as color temperature. By measuring the luminance of the display periodically, a precise and accurate color profile of the flat panel display can be maintained.

17 Claims, 7 Drawing Sheets

METHOD FOR MODELING AND UPDATING A COLORIMETRIC REFERENCE PROFILE FOR A FLAT PANEL DISPLAY

RELATED U.S. APPLICATION

The instant application is a continuation-in-part of U.S. patent application Ser. No. 09/187,161, now abandoned, filed Nov. 6, 1998, entitled "METHOD AND SYSTEM FOR PROVIDING A COLORIMETRIC REFERENCE PROFILE FOR A FLAT PANEL MONITOR," by Evanicky et al., and assigned to the assignee of the present invention, and which is incorporated herein by reference. The instant application also claims priority of Provisional U.S. Patent Application Serial No. 60/171,017, filed Dec. 15, 1999, entitled "A METHOD FOR MODELING AND UPDATING A COLORIMETRIC REFERENCE PROFILE FOR A FLAT PANEL DISPLAY."

FIELD OF THE INVENTION

The present invention relates to the field of display devices. More specifically, the present invention relates to the field of flat panel display devices utilizing liquid crystal display (LCD) technology.

BACKGROUND OF THE INVENTION

Flat panel liquid crystal displays (LCDs) are popular display devices for conveying information generated by a computer system. The decreased weight and size of a flat panel display greatly increases its versatility over a cathode ray tube (CRT) display. Flat panel LCD monitors are used today in many applications including the computer component and computer periphery industries where flat panel LCD monitors are an excellent display choice for lap-top computers and other portable electronic devices. Because flat panel LCD technology is improving, more and more flat panel LCD monitors are rapidly replacing CRT displays in other mainstream applications, such as desktop computers, high-end graphics computers, and as televisions and other multi-media monitors.

In flat panel LCD monitors, much like conventional CRT displays, a white pixel is composed of a red, a green and a blue color point or "spot." When each color point of the pixel is excited simultaneously and with the appropriate energy, white can be perceived by the viewer at the pixel screen position. To produce different colors at the pixel, the intensity to which the red, green and blue points are driven is altered in well known fashions. The separate red, green and blue data that corresponds to the color intensities of a particular pixel is called the pixel's color data. Color data is often called gray scale data. The degree to which different colors can be achieved within a pixel is referred to as gray scale resolution. Gray scale resolution is directly related to the amount of different intensities, or shades, to which each red, green and blue point can be driven.

The method of altering the relative color intensities of the color points across a display screen is called white balance adjustment (also referred to as color balance adjustment, color temperature adjustment, white adjustment, or color balancing). In a display, the "color temperature" of white correlates to the relative percentage contributions of its red, green and blue intensity components. In addition, the "color temperature" of white correlates to the luminous energy given off by an ideal black body radiating sphere at a particular temperature expressed in degrees Kelvin (K). Relatively high degree K color temperatures represent "white" having a larger blue contribution (e.g., a "cooler" look). Relatively small degrees K color temperatures represent "white" having a larger red contribution (e.g., a "warmer" look). Generally, the color temperature of a display screen is adjusted from blue to red while avoiding any yellow-ish or green-ish variations within the CIE chromaticity diagram.

One way to adjust the white balance of a conventional flat panel LCD screen is to alter the gamma and the color look-up tables (LUTs) of the display controller. This method, however, is undesirable because the gray-scale dynamic ranges of the primary colors are severely decreased, causing the display of less stable and less accurate colors.

A novel flat panel LCD screen with dynamically adjustable color balancing system is described in co-pending U.S. patent application Ser. No. 09/087,745, entitled "A MULTIPLE LIGHT SOURCE COLOR BALANCING SYSTEM WITHIN A LIQUID CRYSTAL FLAT PANEL DISPLAY" by Daniel E. Evanicky, filed May 29, 1998, and assigned to the present assignee, which is hereby incorporated by reference. The novel flat panel LCD screen includes two light sources of different color temperatures and whose brightness can be independently controlled. One of the light sources is "cooler" (e.g., 7200 K) and another one of the light sources is "warmer" (e.g., 5600 K). By independently adjusting the brightness of these light sources, different color temperature can be achieved. Very accurate colors may be displayed on such flat panel LCD screen.

The novel flat panel LCD screen employs a very low cost calibration evice known as a "gamma sensor" or a luminance meter. A method of using the "gamma sensor" for calibrating the novel flat panel LCD screen through ratiometric calculations is described in detail in prior-noted co-pending U.S. patent application Ser. No. 09/120,960, entitled "SYSTEM AND METHOD FOR PROVIDING A WIDE ASPECT RATIO FLAT PANEL DISPLAY MONITOR INDEPENDENT WHITE-BALANCE ADJUSTMENT AND GAMMA CORRECTION CAPABILITIES". By combining the luminance measurements of various colors displayed on the flat panel LCD screen and the colorimetric data profile determined at the time of manufacture and stored in the panel's on-board memory, the white point of the monitor can be calculated and reported to the user using suitable software programs.

Although the chromaticity of the phosphor mixture within each of the light sources generally remains the same, the overall lamp luminance gradually degrades over time depending on usage. As the lamps degrade, the white point range of the system narrows. Additionally, the color profile determined at the time of manufacture may no longer accurately reflect the true color characteristics of the display. As a result, the accuracy of white balance adjustments degrade over time. While the degradation may be slight, it may be unacceptable to color critical applications such as desktop publishing. Thus, for users of those color-critical applications, the useful life of the display is significantly shortened.

Accordingly, what is needed is a method and system for providing users with colorimetric information of a flat panel liquid crystal display that remains accurate over time. What is also needed is a method and system for determining the colorimetric information of a flat panel liquid crystal display that takes luminance degradation into account.

SUMMARY OF THE DISCLOSURE

In accordance with embodiments of the present invention, a method and system are disclosed for providing an accurate monitor-specific reference profile for a flat panel LCD monitor over time. The method and system disclosed herein employ a low cost gamma sensor (or luminance meter). Thus, the present method and system are very cost effective.

Embodiments of the present invention are applicable to flat panel LCD monitors with dynamically adjustable color-balancing capabilities. The white balance adjustment mechanisms preferably include the provision of two pairs of light sources of different color temperatures, whose brightness can be independently varied (and distributed through a light distribution mechanism). By varying the brightness (intensity) of the light sources, the color temperature of the display can be altered. Further, the flat panel LCD monitors preferably include memory devices for storing reference profiles that are monitor specific. Further, the memory devices are also configured to be accessible by host computers, display micro-controller units or gamma sensors (e.g. luminance sensors) such that the reference profiles can be accessed during color calibration.

According to an embodiment of the present invention, the reference profiles are updated at reasonable intervals by measuring the luminance of the primary colors (Red, Green and Blue) at various brightness settings with a gamma sensor (or luminance sensor). The luminance data are then used for correcting the extensive colorimetric reference profile of the display to account for luminance degradation. By using an updated colorimetric reference profile, accurate color information of the display can be provided to the users. Because a low cost gamma sensor is used for updating the color reference profile, the embodiments of the present invention are very cost effective.

Embodiments of the present invention include the above and further include a method for updating a colorimetric reference profile for a flat panel liquid crystal display (LCD) monitor including a first light source having a first color temperature and a second light source having a second color temperature. The present method includes the steps of: displaying a plurality of monochromatic windows one at a time on the flat panel LCD monitor at a plurality of brightness settings; synchronous with the step of displaying, measuring luminance values of the displayed images with a gamma sensor; accessing a previously stored colorimetric reference profile of the flat panel LCD monitor; and, determining an updated colorimetric reference profile for the flat panel LCD monitor based on the luminance values of those previously stored and the current luminance measurements. In the present embodiment, the updated colorimetric reference profile accurately reflects effects of luminance degradation of the first light source and the second light source.

BRIEF DESCRIPTIONS OF THE DRAWINGS

The accompanying drawings, which are incorporated in and form a part of this specification, illustrate embodiments of the present invention and, together with the description, serve to explain the principles of the invention.

Figure 6:
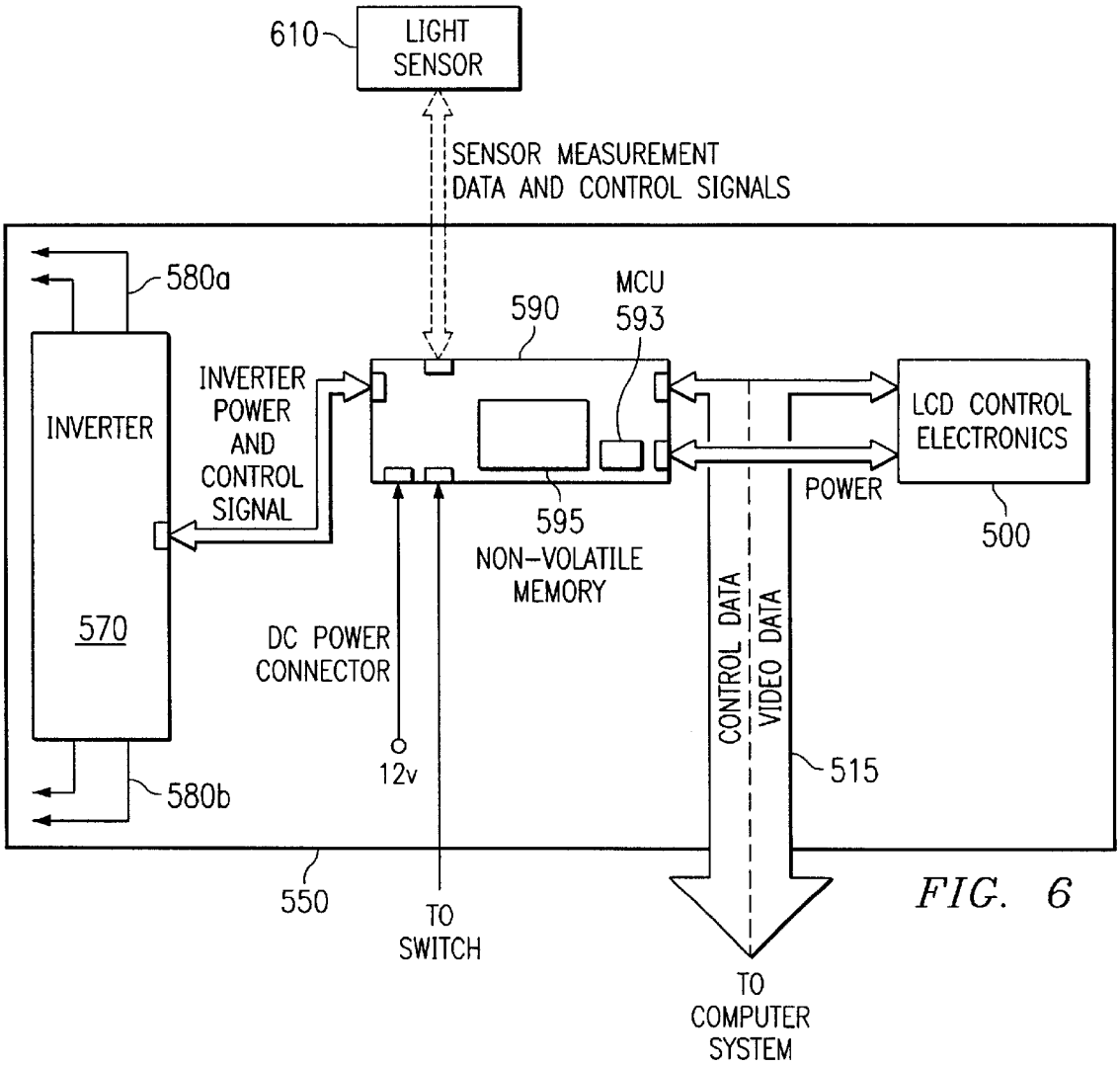

FIG. 6 a block diagram illustrating an exemplary control logic for the flat panel LCD monitor according to one embodiment of the present invention.

Figure 7:
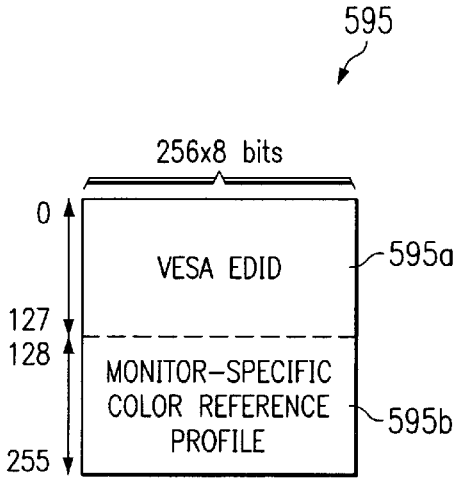

FIG. 7 illustrates an address map of the memory device used for storing VESA EDID information and monitor-specific reference profile according to the present invention.

Figure 8:
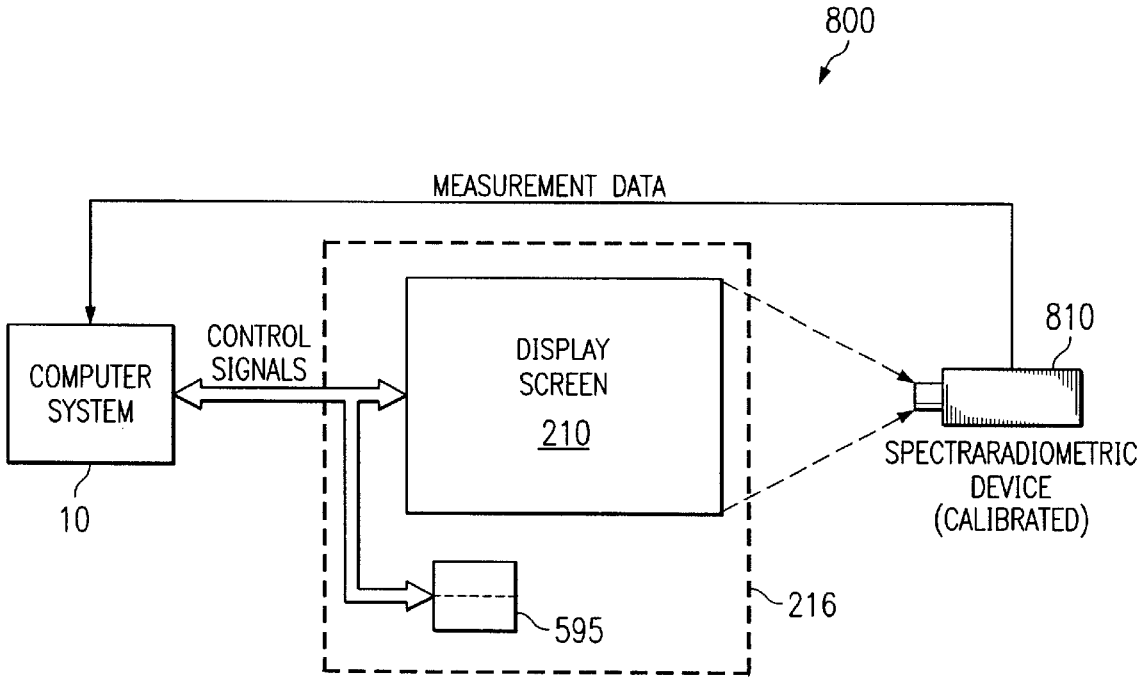

FIG. 8 is a block diagram illustrating the system for providing a monitor-specific reference profile for a flat panel LCD monitor in accordance with the present invention.

Figure 9:
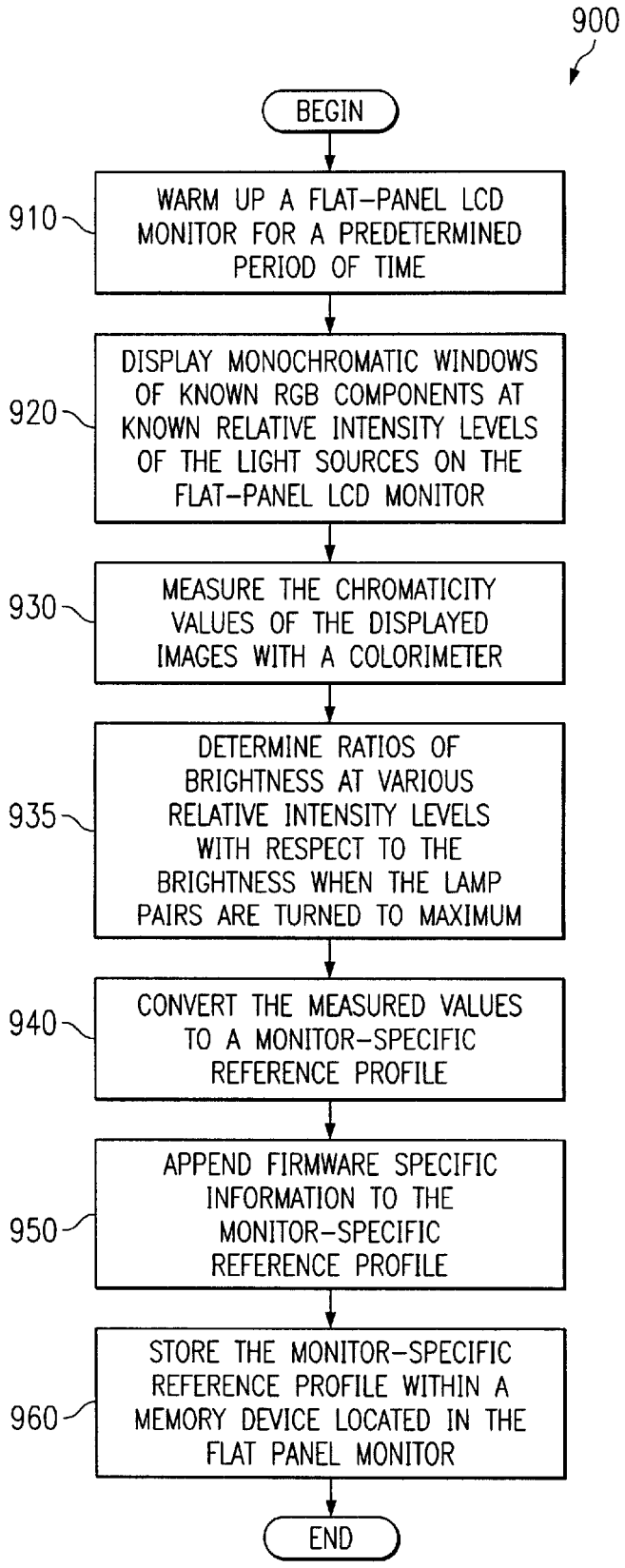

FIG. 9 is a flow diagram illustrating the steps of a process for providing a monitor-specific reference profile for a flat panel LCD monitor in accordance with an embodiment of the present invention.

Figure 10A:
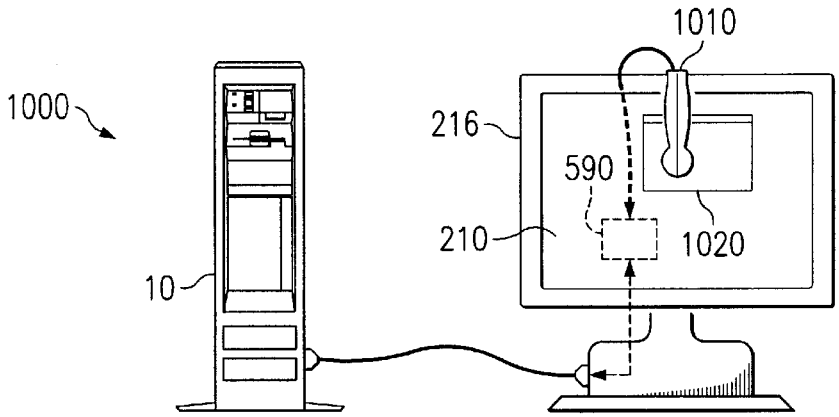

FIG. 10A is a block diagram illustrating the system for updating a monitor-specific reference profile for a flat panel LCD monitor during its service life in accordance with an embodiment of the present invention.

Figure 10B:
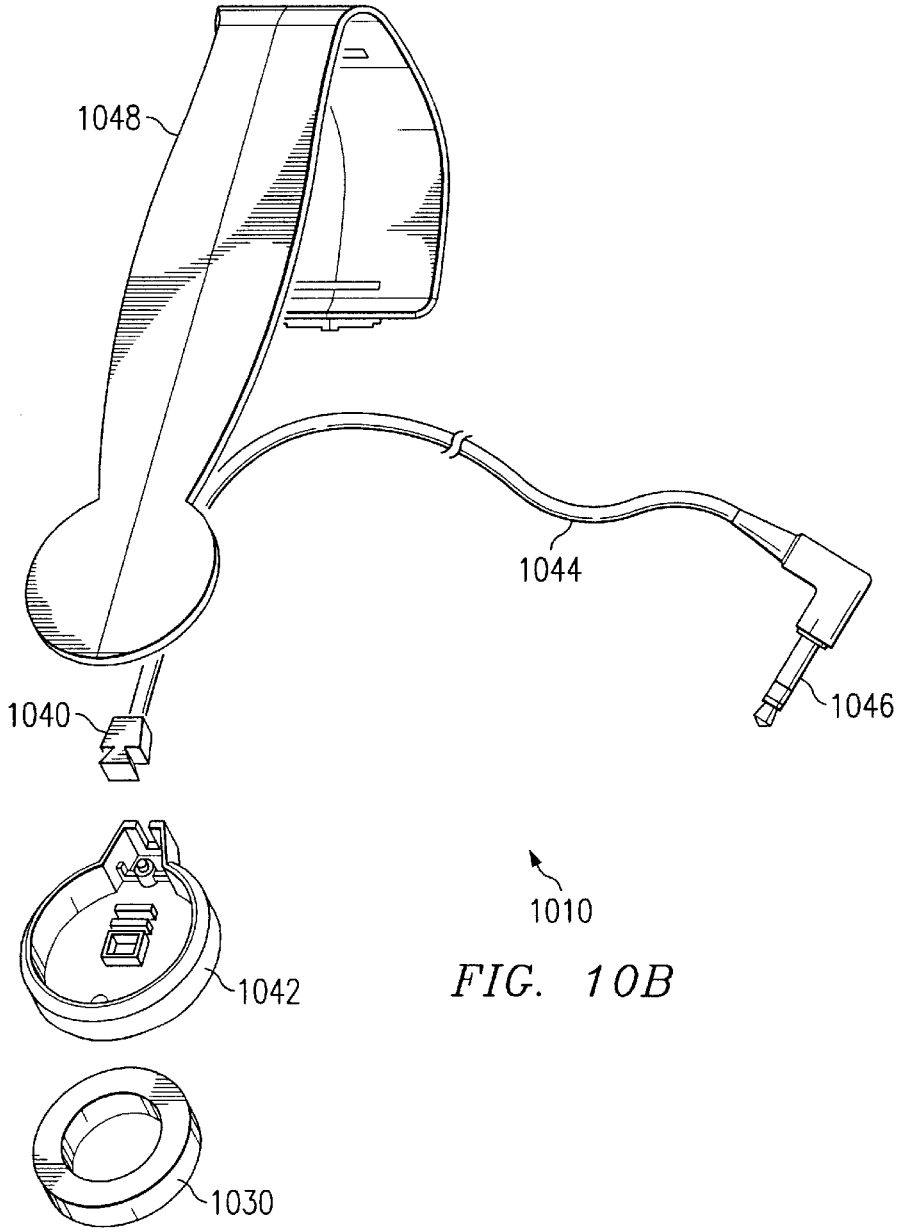

FIG. 10B illustrates an exploded view of an exemplary gamma sensor that may be used in conjunction with the system illustrated in FIG. 10A.

Figure 11:
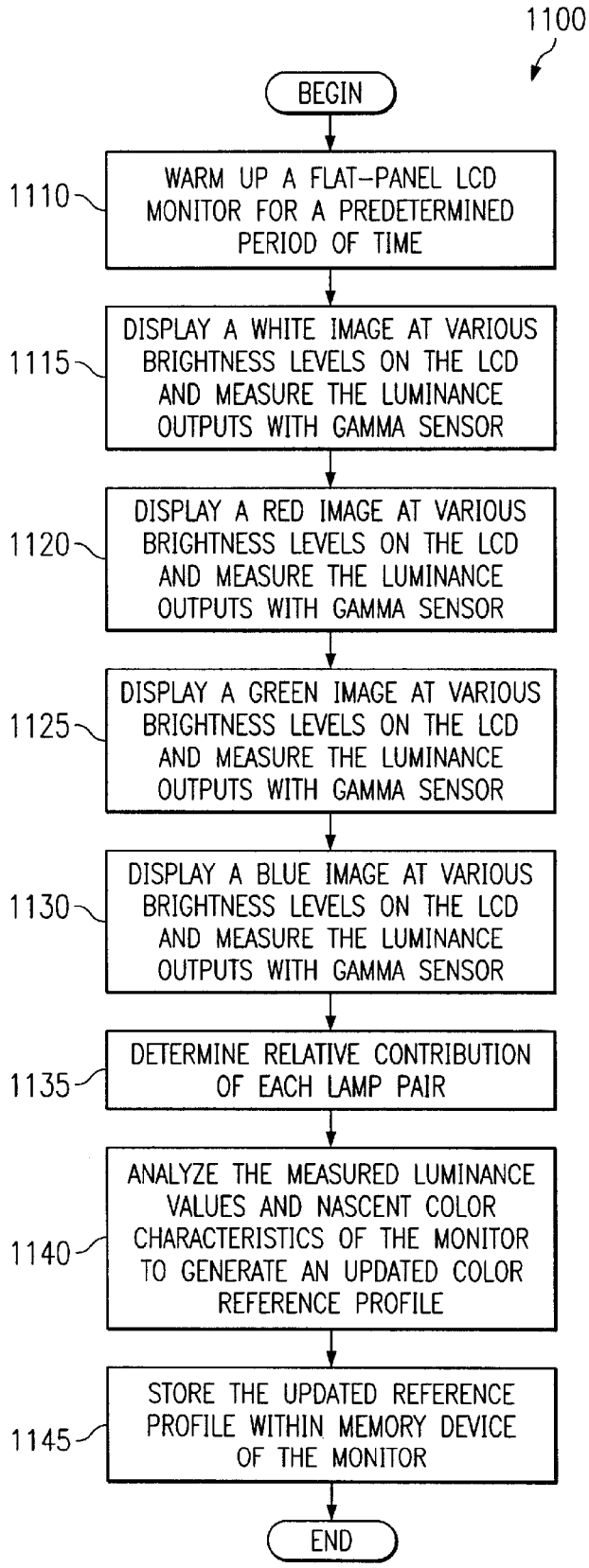

FIG. 11 is a flow diagram illustrating the steps of a process for updating a monitor-specific reference profile for a flat panel LCD monitor during its service life in accordance with an embodiment of the present invention.

DETAILED DESCRIPTION OF THE PREFERRED EMBODIMENTS

Reference will now be made in detail to the present embodiments of the invention, examples of which are illustrated in the accompanying drawings. While the invention will be described in conjunction with the present embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description, for purposes of explanation, numerous specific details are set forth in order to provide a thorough understanding of the present invention. It will be obvious, however, to one skilled in the art, upon reading this disclosure, that the present invention may be practiced without these specific details. In other instances, well-known structures and devices are not described in detail in order to avoid obscuring aspects of the present invention.

Unless specifically stated otherwise as apparent from the following discussions, it is appreciated that throughout the present invention, discussions utilizing terms such as "converting", "determining", "analyzing", "storing", or the like, refer to the actions and processes of a computer system, or similar electronic computing device. The computer system or similar electronic device manipulates and transforms data represented as physical (electronic) quantities within the computer system's registers and memories into other data similarly represented as physical quantities within the computer system memories into other data similarly represented as physical quantities within the computer system memories or registers or other such information storage, transmission, or display devices.

COMPUTER SYSTEM ENVIRONMENT OF THE PRESENT INVENTION

Figure 1:
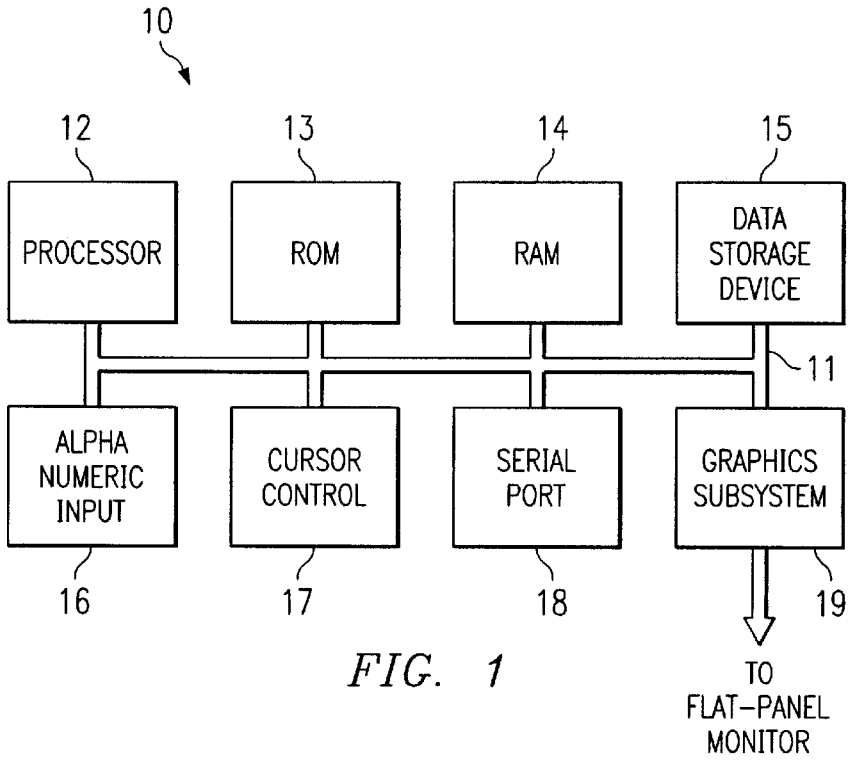
FIG. 1 illustrates an exemplary computer system used as part of a computer graphics system in accordance with one embodiment of the present invention.

With reference to FIG. 1, portions of the present invention are comprised of computer-readable and computer executable instructions which reside, for example, in computer-usable media of a computer system. FIG. 1 illustrates an exemplary computer system 10 used as a part of a system for providing a monitor-specific reference profile for a flat panel monitor in accordance with one embodiment of the present invention. It is appreciated that computer system 10 of FIG. 1 is exemplary only and that the present invention can operate within a number of different computer system platforms including general purpose computer systems, embedded computer systems, and stand alone computer systems specially adapted for generating and displaying graphics images. It is also appreciated that the various aspects of the present invention can be made to function if the flat panel monitor is addressed by a remote computer system, or a "server," which also interacts with other similar flat panel monitors within its network.

Computer system 10 of FIG. 1 includes an address/data bus 11 for communicating information, and a central processor unit 12 coupled to bus 11 for processing information and instructions. Computer system 10 also includes data storage features such as computer-usable volatile memory 14, e.g. random access memory (RAM), coupled to bus 11 for storing information and instructions for central processor unit 12, computer-usable non-volatile memory 13, e.g. read only memory (ROM), coupled to bus 11 for storing static information and instructions for the central processor unit 12, and a data storage device 15 (e.g., a magnetic or optical disk and disk drive) coupled to bus 11 for storing information and instructions. Computer system 10 further includes a serial port 18 for coupling to peripheral devices such as a color sensing device. A graphics subsystem 19, which may include a graphics co-processor for offloading computation burden from central processor unit 12 and embedded DRAM for increased memory bandwidth, coupled to bus 11, is also included in computer system 10 of FIG. 1. In one embodiment, graphics subsystem 19 is configured for coupling to a flat panel LCD monitor.

Computer system 10 of the present invention also includes an optional alphanumeric input device 16 including alphanumeric and function keys coupled to bus 11 for communicating information and command selections to central processor unit 12. Computer system 10 also optionally includes a cursor control device 17 coupled to bus 11 for communicating user input information and command selections to central processor unit 12. Optional cursor control device 17 allows the computer user to signal dynamically the two-dimensional movement of a visible symbol (cursor) on a display screen. Many implementations of cursor control device 17 are known in the art including a trackball, mouse, touch pad, joystick, or special keys on alphanumeric input device 16 capable of signaling movement of a given direction or manner of displacement. Alternatively, it will be appreciated that a cursor can be directed and/or activated via input from alphanumeric input device 16 using special keys and key sequence commands. The present invention is also well suited to directing a cursor by other means such as, for example, voice commands. Computer system 10 may further include a communication device (e.g. a modem) for communicating with a computer network.

General Description of a Flat Panel LCD Monitor

Figure 2:
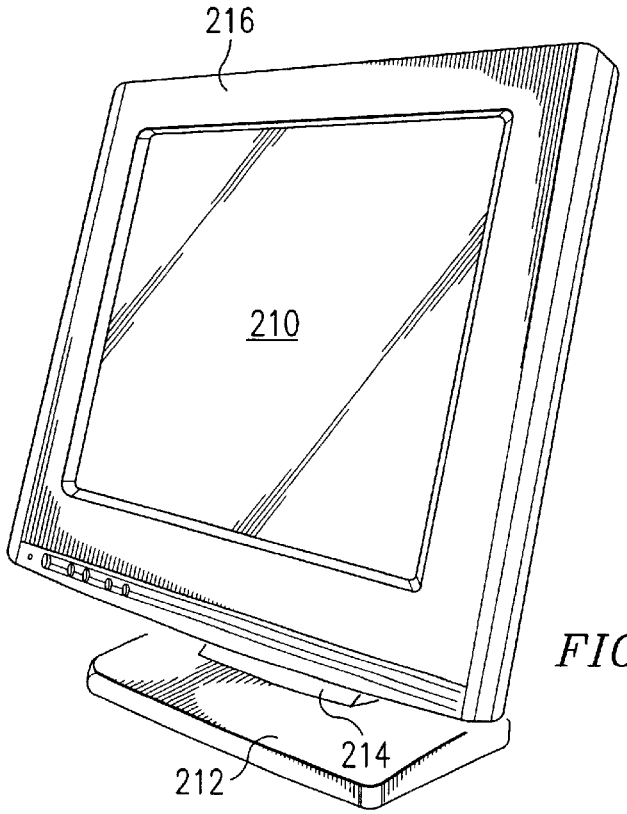
FIG. 2 illustrates a display assembly of the present invention including wide aspect ratio display, stand and base components.

FIG. 2 illustrates a monitor 216 in accordance with the present invention. The monitor 216 includes a display screen 210 for viewing high information content display. The flat panel display screen 210 ("display 210 ") of the present invention is digitally addressed in an (x, y) matrix of pixels over the entire area of the display. Display screen 210 includes a thin film transistor (TFT) liquid crystal display layer. The monitor 216 also includes a height adjustable stand 214 that is supported by base 212. Stand 214 (or"tower") allows both elevation and tilt adjustments. The monitor 216 of the present invention has a high resolution for the display of high information content, such as graphics images and/or textual information including alphanumeric characters.

The monitor 216, in one implementation, supports the SXGA-Wide display format. The SXGA-Wide display format has 1,600 pixels across the horizontal dimension and 1,024 pixels down the vertical dimension. The aspect ratio of the SXGA-Wide compliant implementation of the monitor of the present invention is approximately 1.6:1. Within the context of the present invention, an aspect ratio greater than 1.3:1 is considered to be a wide aspect ratio. The present embodiment having a display screen of 369.6 mm by 236.54 mm is therefore a large viewing area wide aspect ratio flat panel display unit. Because the pixel pitch (e.g., the distance between pixel centers) of the monitor 216 is 0.231 mm, it is very well suited for the display of textual information (e.g., alphanumeric characters) as well as graphic images, both being high information content. It should be noted that the present implementation is exemplary only, and that the present invention may be embodied in flat panel monitors that support other display formats.

Therefore, the monitor 216 of the present invention is well suited for desktop publishing applications, graphics design applications, digital photography and video applications, medical imaging, pre-press soft-proofing, etc. A more detailed description of the wide aspect ratio flat panel LCD monitor 216 can be found in co-pending U.S. patent application Ser. No. 09/120,983, filed Jul. 22, 1998, and entitled "A Large Area Wide Aspect Ratio Flat Panel Monitor Having High Resolution For High Information Content Display," which is hereby incorporated by reference.

Figure 3:
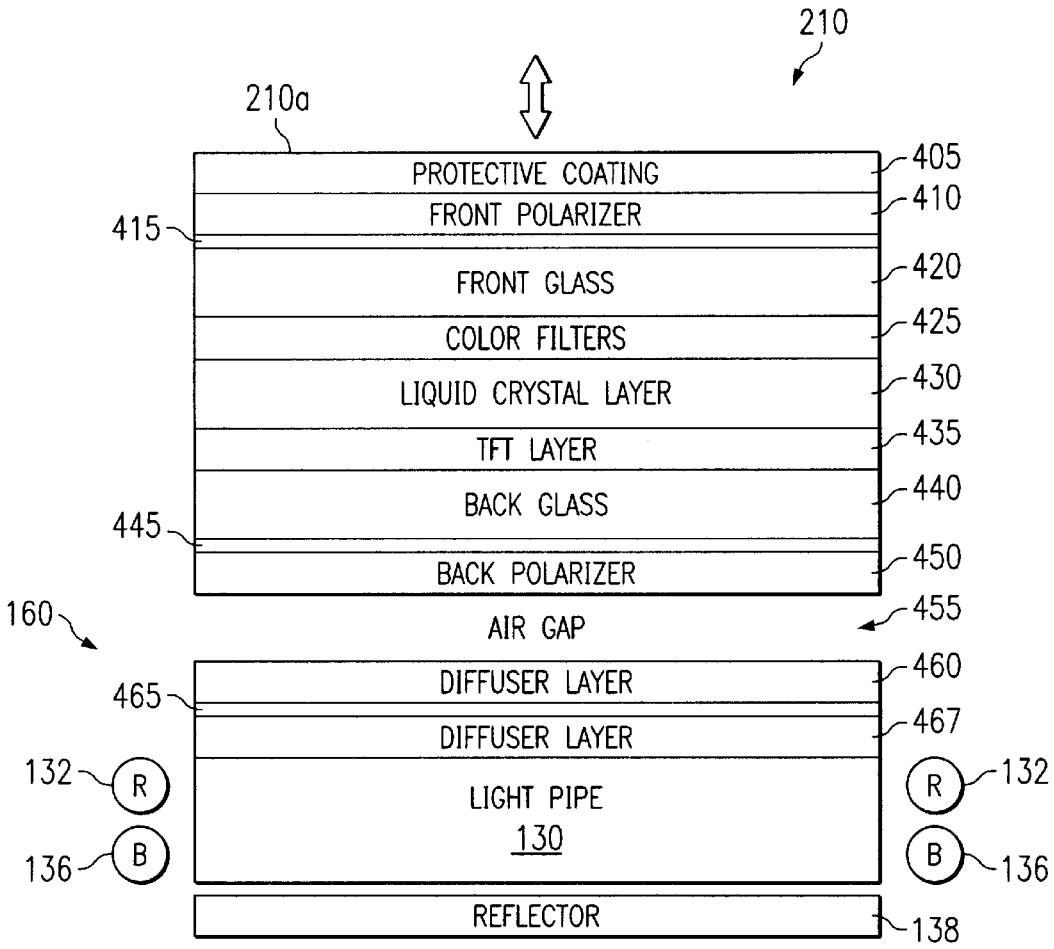
FIG. 3 is a cross section through the layers of the wide aspect ratio liquid crystal display according to one embodiment of the present invention.

FIG. 3 is a cross section of the layers of the flat panel display screen 210 in accordance with one embodiment of the present invention. The flat panel display screen 210 can be used with a fixed-in-place backlighting unit or can be used with a removable backlighting assembly. Also, although FIG. 3 illustrates an edge lighting embodiment, display 210 can also be directly backlit as described further below. The layers of display screen 210 are described with respect to FIG. 3 from the bottom up ending with the viewed surface 210*a*.

The flat panel display 210, in accordance with one embodiment of the present invention, provides white balance adjustment by independently varying the brightness of two pairs of light sources (e.g., cold cathode flourescent CCF tubes) 132 and 136 that belong to a lighting configuration 160. For a predetermined range of color temperatures, having a minimum temperature (e.g., 5,000 K) and a maximum temperature (e.g., 7,000 K), a first pair of light sources 132 are provided that have a wavelength spectrum with an overall color temperature less than the minimum temperature of the predetermined range; herein, light sources 132 with this characteristic are called the "red" light sources for convenience. Also, a second pair of light sources 136 are provided that has a wavelength spectrum with an overall color temperature that is greater than the maximum temperature of the predetermined range; herein, light sources 136 with this characteristic are called the "blue" light sources for convenience.

Also in the lighting configuration 160 shown in FIG. 3, the red light sources 132 are optically coupled to provide light to a light pipe 130. The red light sources 132 are positioned along an edge of the light pipe 130. Likewise, the blue light sources 136 are optically coupled to provide light to light pipe 130. The blue light sources 136 are also positioned along an edge of light pipe 130. In the embodiment 160 of FIG. 3, the light sources 132 and 136 are long thin tubes which are positioned on opposite sides of the planar light pipe 130. The light sources 132 and 136 are positioned to be substantially parallel with each other. The power supply for each pair of light source 132 and 136 receive a separate voltage signal for independently controlling its brightness with respect to the other pair of light source. It is appreciated that the positions of the red tubes 132 and the blue tubes 136 can be switched without departing from the scope of the invention.

Other embodiments of the light configuration in accordance with the present invention, such as "L-shaped" light tubes, may be found in co-pending U.S. patent application Ser. No. 09/087,745, filed on May 29, 1998, and entitled "A Multiple Light Source Color Balancing System Within A Liquid Crystal Flat Panel Display," and prior-noted co-pending U.S. patent application Ser. No. 09/120,983, filed Jul. 22, 1998, and entitled "A Large Area Wide Aspect Ratio Flat Panel Monitor Having High Resolution For High Information Content Display," both of Which are hereby incorporated by reference.

It should also be appreciated that, although the lamp light sources are described here as a pair of lamps for each color, a single light source per color is also possible as described in prior-noted co-pending U.S. patent application Ser. No. 09/087,745, entitled "A Multiple Light Source Color Balancing System Within A Liquid Crystal Flat Panel Display."

Within display screen 210 of FIG. 3, a rear reflector layer 138 is positioned on one side of the light pipe 130. On the other side of the light pipe 130, diffuser layers 460 and 467 (mylar) are positioned next to one or more brightness enhancement layers (BEFs) 465. An air gap 455 is then disposed. Layer 460 can optionally be covered by a protective layer (not shown). Layer 460 is then followed by a back or rear polarizer layer 450 that is positioned next to the air gap 455. The display screen 210 includes the back polarizer layer 450 followed by bi-refringegent compensation film 445 which is followed by a back glass layer 440.

The back glass layer 440 of FIG. 3 is followed by a selectively energized transistor layer 435 ("TFT layer") and an LCD layer 430, followed by red/green/blue color filter layers 425. The TFT layer 435 is composed of selectively addressed amorphous silicon thin film transistors (TFT) which charge up their respective capacitors. The color filter layer 425 is followed by a front glass layer 420. The front glass layer 420 is followed by another compensation film layer 415 (e.g., a biaxially stretched film birefringence compensation layer) which is followed by a second or front polarizer layer 410. A protective coating layer 405 is placed in front of the front polarizer layer 410 and provides a non-glare viewing surface.

The white balance or color temperature of display screen 210 is maintained and adjusted using the two pairs of independently controlled light sources 132 and 136. The white balance is adjusted by altering the brightness of the pairs of light sources 132 and 136 independently. The phosphor ratios (e.g., contribution of red, green and blue phosphors) of the two pairs of light sources 132 and 136 are selected so that the white balance can be adjusted by varying the intensities of the light sources 132 and 136. The light pipe 130 is acrylic and contains an extraction system that uniformly distributes the light from each light source across the viewing area of the display, thereby providing the color-adjusted light uniformly over display 210. It should be appreciated that other embodiments of the present invention may have multiple light pipes, as described in prior-noted co-pending U.S. patent application Ser. No. 09/087,745, entitled "A Multiple Light Source Color Balancing System Within A Liquid Crystal Flat Panel Display."

Significantly, the present invention provides for a mechanism and method for adjusting its color temperature by adjusting the brightness of the two pairs of light sources 132 and 136 of lighting configuration 160. Particularly, the monitor 216 includes an white-balance adjustment control signal input configured for coupling to a digital computer system to receive a white-balance adjustment control signal, and control circuitry responsive to the white-balance adjustment control signal for controlling the brightness of the two pairs of light sources 132 and 136. In addition, in one embodiment of the present invention, the monitor 216 further comprises circuitry configured for coupling to a light-sensing device (e.g., calorimeters, luminance sensors, etc.) that measures optical characteristics of the display screen 210.

Figure 4:
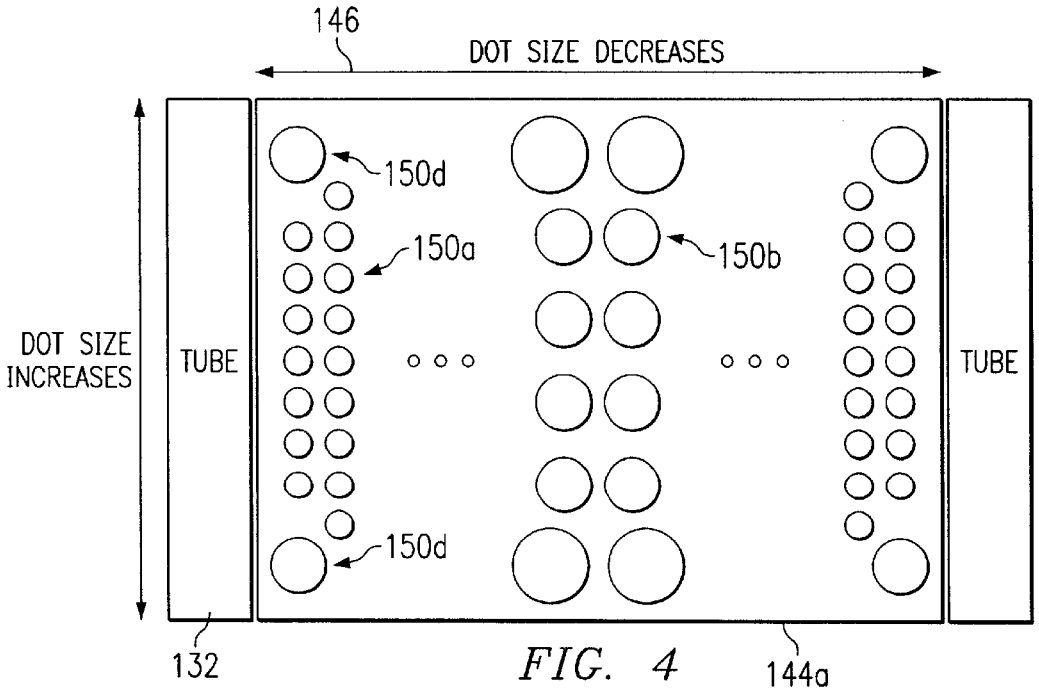
FIG. 4 illustrates a top view of an extraction pattern disposed on the surface area of a light pipe in accordance with embodiments of the present invention that use two light sources of different color temperatures.

FIG. 4 illustrates a top view of an exemplary extraction pattern 144 a that can be applied to the bottom of light pipe 130 within display screen 210. The extraction pattern 144*a* is designed to uniformly illuminate the LCD layer 430, at any brightness. Extraction dots are applied directly to the lower surface of the light pipe 130. To accomplish this uniform distribution of light, extraction dots generally decrease in size in a proportion to their distance from the middle of the light pipe 130. Extraction dots 150*a* are smaller since they are relatively close to the light sources 132 and 136. Extraction dots 150*b* are slightly larger since they are relatively farther from to the light sources 132 and 136 than dots 150*a*. It is appreciated that extraction pattern 144*a* also includes larger sized dots 150*d* at the corners near the light source 132 because the tube 132 is not as bright at the ends as in the middle sections of the tube. Variations in the extraction dot patterns, which may be equally applied to the present invention, may be found in U.S. Pat. No. 5,593,221, by Evanicky et al., which is assigned to the assignee of the present invention, and which is hereby incorporated by reference. It should be appreciated that the extraction dot pattern is designed to a specific lamp and light pipe lighting system. A system that employs, for instance, a plurality of light emitting diodes linearly arrayed along the edge of the light pipe would not require large sized dots at the corners.

Figure 5:
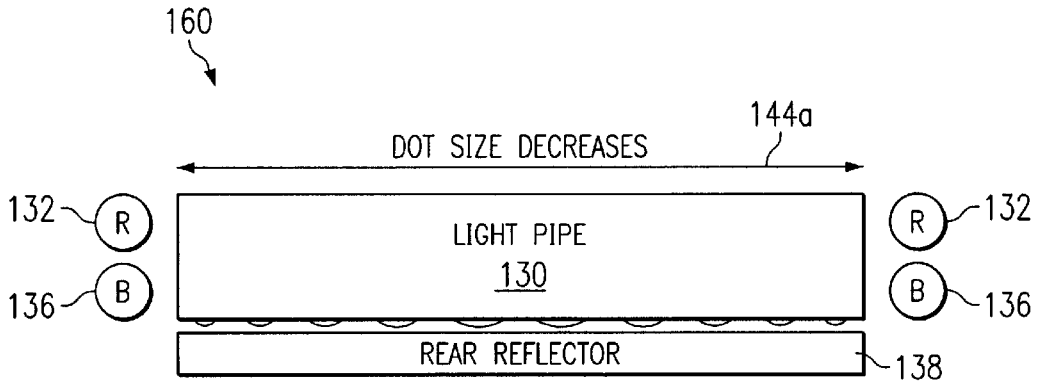
FIG. 5 illustrates a cross section of the lighting configuration of the LCD panel embodiment of FIG. 3 showing the orientation of the extraction pattern in accordance with the present invention.

FIG. 5 illustrates the lighting configuration 160 of light pipe and light sources (as shown for display 210 of FIG. 3) taking into consideration the orientation of its light extraction pattern. Within display screen 210, extraction pattern 144*a* is designed to uniformly distribute light to the LCD layer 430, as the brightness of light sources 132 and 136 varies. Light extraction pattern 144*a* is shown in FIG. 5 in cross section as a thin line applied to the underside of light pipe 130. As shown, the dot sizes decrease within pattern 144*a* from the middle of the light pipe 130 towards the edges of the light pipe 130.

Monitor-Specific Reference Profile for a Flat Panel LCD Monitor

FIG. 6 is a block diagram illustrating control circuitry 550 of the monitor 216 of the present invention. Control circuitry 550 includes LCD display circuit 500, inverter circuit 570, and system electronics (or, glue logic) 590. As illustrated, LCD display circuit 500 receives video data from an information originating source, e.g. computer system 10, via a bus 515 (e.g., a dual channel low voltage differential voltage signals "LVDS" bus or a transition minimized differential signaling "TMDS" bus), and displays an image representative of the image data by selectively energizing transistors within transistor layer 435 (FIG. 3). Circuit 500 includes LCD display electronics that are well known in the art. Therefore, specific implementation details of the LCD display circuit 500 are not described herein to avoid obscuring aspects of the present invention.

With reference still to FIG. 6, according to the present embodiment, inverter circuits 570 are used to control the light sources (e.g., 132 and 136, etc.) described above in the lighting configurations. The inverter circuitry 570 contains the provision for independently providing power to each light source (e.g., at an operating voltage of 745 volts with a striking voltage capability of 2,000 volts) thereby allowing independent dimming control of each light source. Each inverter circuit of 570 contains a transformer for supplying a high voltage signal to the light sources 132 and 136 and also contains a switch circuit for turning the tubes off. Light sources 132 and 136 are separately coupled to receive power from power supply lines 580*a*–580*b*. In one embodiment, the current supplied to the inverter circuitry 570 is approximately 2 amps at 12 volts.

In the present embodiment, operations of the inverter circuits 570 are controlled by system control circuitry 590 which receives control signals from computer system 10 via an inter-integrated circuit ($I^2C$) interface. System control circuitry 590 further comprises an interface for coupling to a gamma sensor 610. Micro-controller unit 593, which is part of the system control circuitry 590, receives the control signals from the computer system and forwards the appropriate commands to other panel functional blocks and/or the gamma sensor. In the particular embodiment as illustrated, chromaticity data may be transmitted directly from the gamma sensor 610 to the flat panel LCD monitor 216. Further, control signals may also be transmitted from computer system 10 to the gamma sensor 610 via flat panel LCD monitor 216.

In the current embodiment, MCU 593 acts as an interface between the host computer and the gamma sensor 610, and communicates the measurement data to an application program within the host computer system 10, which then sends appropriate control signals to the light sources 132 and 136.

In one embodiment of the present invention, the light sources 132 and 136 cannot be completely turned off. The minimum brightness of the light sources is roughly 25% of the maximum brightness. Not being able to turn off the light sources 132 completely makes it difficult to track the contribution of each light source to the overall colorimetry. Thus, in that embodiment, it may be necessary to extrapolate what the colorimetry would be. This makes for a certain loss of accuracy if the ratiometric calculation is not accurate enough.

In another embodiment of the present invention, light sources 132 and 136 can be individually and completely shut off. In that embodiment, it would be easier to track the contribution of each light source to the overall colorimetry. Further, in that embodiment, it is not necessary to apply extrapolation techniques in the calculation of the white point.

In the present embodiment, system control circuitry 590 further comprises a memory device 595 for storing a monitor-specific reference profile of the flat panel LCD monitor 216. VESA's EDID (Extended Display Information Data) information may also coexist in the same memory device 595. VESA's EDID standard is defined by the EDID 1.2 specification, which is well known in the art. According to the present invention, the information stored within the memory device 595 is accessible by host computer system 10. Further, the memory device 595 may be a erasable-programmable read-only-memory (EPROM), programmable read-only-memory (PROM), flash memory, or any other types of non-volatile memory devices. Details of the memory device 595 and the monitor-specific reference profile will be discussed below.

In order to provide sufficient bandwidth for rendering images on the monitor 216, in the present embodiment, a dual channel LVDS interface is used where video data is sent at the rate of two pixels for each LVDS output clock. An exemplary implementation of the present dual channel LVDS bus and an 12C interface for a flat panel LCD monitor can be found in co-pending U.S. patent application Ser. No. 09/121,276, filed Jul. 22, 1998, entitled "Digital Interface for Digital Flat Panel Monitors", by Oscar Medina, assigned to the present assignee, and which is hereby incorporated by reference. It should be appreciated that, although LVDS signal standard is employed in one embodiment of the present invention, other signal transmission standards can also be used by the present invention for the display signal including emitter coupled logic (ECL) and transition minimized differential signaling (TMDS) technologies in single-channel and multiple-channel configurations. It should be apparent to those of ordinary skill in the art that other signal transmitting standards having sufficient bandwidth and suitable for supporting an SXGA-WIDE display format may also be used.

FIG. 7 illustrates an address map of the memory device 595 of FIG. 6. According to the present invention, the memory device 595 may be used for storing the monitor-specific reference profile, and may be used for storing VESA's EDID information.

In the illustrated embodiment, the memory device 595 has a capacity of 256×8-bits (256 bytes) and is organized with an address scheme ranging from 0 to 255. It is appreciated that the size of 256 bytes is exemplary only and memory 595 can be of any size depending on the level of precision and accuracy desired. Particularly, memory device 595 includes two memory sections: a first memory section 595*a*, and a second memory section 595*b*. In the present embodiment, the first memory section 595*a* is programmed to store EDID information, and the second memory section 595*b* is programmed to store a monitor-specific reference profile of flat panel LCD monitor 216. VESA EDID is well known in the art, and is defined by the VESA-EDID standard. It should be appreciated, however, that the address scheme illustrated in FIG. 7 is exemplary only, and that the present invention may be embodied in other memory addressing schemes as well.

According to the present invention, the monitor-specific reference profile includes data representative of a collection of tri-stimulus values recorded during manufacture of the flat panel LCD monitor. Further, the monitor-specific reference profile contains a table that correlates voltage settings of the lamps with color temperatures, brightness levels, etc. Typically, the information is programmed into the memory device 595 shortly after the monitor 216 is assembled. The memory device 595 may also be re-programmed any time during the service life of the monitor 216 to update its reference profile. Specific details of the programming and re-programming processes will be described below.

Significantly, memory device 595 is accessible by a host computer (e.g. computer system 10), and by a gamma sensor 610 (e.g., a gamma sensor) that is coupled to the flat panel LCD monitor 216. The memory device 595, which stores the monitor-specific reference profile, allows users to subsequently calibrate the flat panel LCD monitor 216 to a desired color temperature and white-balance point by using an inexpensive gamma (or luminance) sensor. A method of calibrating the flat panel LCD monitor 216 using an inexpensive gamma (or luminance) sensor is described in co-pending U.S. patent application Ser. No. 09/120,960, filed Jul. 22, 1998, entitled "System and Method for Providing a Wide Aspect Ratio Flat Panel Display Monitor Independent White-Balance Adjustment and Gamma Correction Capabilities", by Evanicky et al, which is assigned to the present assignee and which is hereby incorporated by reference.

FIG. 8 is a block diagram illustrating a system 800 for providing a monitor-specific reference profile for the flat panel LCD monitor 216 in accordance with the present invention. Specifically, the system 800 of the present invention includes a computer system 10, a flat panel LCD monitor 216 with display screen 210 and memory device 595, and a calibrated spectraradiometric device 810. In one embodiment of the present invention, spectraradiometric device 810 may be a Chromatek IV colorimeter which is available from Sequel Imaging, Inc. of Londonderry, N.H. However, it is appreciated that other calorimeters or spectraradiometers, such as Color Analyzer CA-110, manufactured by Minolta Co. of Japan, may also be used. These colorimeters/spectraradiometers are well known in the art, and, therefore, specific details of these calorimeters are not described herein to avoid obscuring aspects of the present invention.

With reference still to FIG. 8, computer system is coupled to flat panel LCD monitor 216 for providing video data and control signals. As discussed above, video data may be transmitted via a dual channel LVDS data bus, and control signals may be transmitted via an $I^2C$ interface running in parallel with the dual channel LVDS data bus. Control signals may also be transmitted via other buses such as the universal serial bus (USB). In one embodiment of the present invention, computer system 10 provides control signals for adjusting a white balance point of the display screen 210 by adjusting the relative intensity of the light sources 132 and 136 (FIG. 3).

In operation, during factory calibration, the computer system generates video data corresponding to a plurality of monochromatic "windows" of known primary colors at known light-source intensity levels, and transmits the video data to the flat panel LCD monitor 216 to be displayed on display screen 210. In the present embodiment, each image is displayed at four different combinations of light-source intensity levels. Particularly, in one embodiment, each image is displayed with the "red" and "blue" lamps set at the following intensity levels shown in Table 1 below:

TABLE 1

| | "Red" Lamp 132 | "Blue" Lamp 136 |
|---|---|---|
| Setting 1 | Maximum | Maximum |
| Setting 2 | Maximum | Minimum |
| Setting 3 | Minimum | Maximum |
| Setting 4 | Minimum | Minimum |

The colorimeter 810 measures the chromatic characteristics (e.g., tri-stimulus values Yxy) of the monochromatic windows as they are displayed, and stores the measured values within computer system 10. It should be appreciated that, in the present embodiment, the colorimeter 810 is controlled by computer system 10 such that capturing of the chromatic characteristics can be performed synchronously with the displaying of the monochromatic windows and the adjusting of the color temperature.

After the necessary chromatic measurements are recorded, they are stored as part of the monitor's reference profile. The format of the monitor-specific reference profile is arbitrary.

FIG. 9 is a flow diagram illustrating a process 900 for providing a monitor-specific reference profile for a flat panel LCD monitor in accordance with the present invention. It should be appreciated that the process 900 as illustrated in FIG. 9 is preferably carried out at the factory where the flat panel LCD monitor 216 is assembled. However, process 900 may also be carried out at any later point in the monitor's service life (e.g. after new light sources are installed) in order to have its reference profile re-entered into memory 595.

As illustrated, at step 910, a flat panel LCD monitor 216 is turned on, and warmed up for several minutes. According to the present invention, the chromatic characteristics of a display screen of a flat panel LCD monitor 216 are somewhat unstable during the first few minutes of operation, and, therefore, monitor 216 is preferably warmed-up for several minutes before chromatic characteristics are measured. However, it should be noted that the chromaticity values (e.g. tri-stimulus values Yxy) change in a known and predictable manner provided that the enviromental conditions, the start conditions, and the monitor package design remain the same. Therefore, it is possible to enter known offsets into the Yxy measurements if the calibrator wishes to shorten the process.

As illustrated, at step 920, a series of monochromatic windows having known primary colors are displayed at known relative light-source intensity settings on the display screen 210 of the flat panel LCD monitor 216. In the present embodiment, each image is displayed with the "red" lamps 132 and "blue" lamps 136 set at various intensity settings (e.g., settings 1, 2, 3 and 4 of Table 1). For example, a monochromatic window with sub-pixel values corresponding to pure white (e.g., RGB full on) is displayed at the four different light-source intensity levels of Table 1. Then, a monochromatic window with pixel values corresponding to pure red (e.g., R-pixels full on, G-pixels and B-pixels full off) is displayed at those relative light-source intensity levels. The process is repeated for a collection of different color values including green and blue. A collection of other various shades of red, green, and blue may also be displayed such that the natural gamma responses of the display screen 210 can be more accurately determined. It should be appreciated, however, that many other combinations of the intensity levels may also be used to achieve the goals of the present invention depending on the interpolative mathematic algorithms employed.

At step 930, the chromaticity values of the monochromatic windows are measured by a colorimeter as they are displayed on the screen. The colorimeter used may be an expensive color analyzer specifically designed for measuring tri-stimulus values of LCD panels, such as Color Analyzer CA-110 of Minolta Co., and Chromatek IV from Sequel Imaging, Inc. It should be appreciated that step 920 is carried out concurrently with step 910 such the chromatic characteristics of the images may be measured when they are displayed. According to the present invention, the chromaticity of the displayed images becomes unstable after the relative intensity levels of the light sources 132 and 136 are adjusted. Therefore, in the present embodiment, measurements are preferably taken thirty to forty seconds after an adjustment to the intensity levels is made such that transient chromatic instability of the LCD display screen can be avoided.

At step 935, the present embodiment calculates the luminance ratios at various lamp intensity settings (e.g., settings 2, 3 and 4 of Table 1) with respect to the luminance at the maximum intensity setting (e.g., setting 1 of Table 1). For example, the luminance value measured at setting 2 is divided by the luminance value measured at setting 1.

At step 940 of FIG. 9, the measured chromatic values (e.g. tri-stimulus values Yxy) are analyzed and are converted to a monitor-specific reference profile. In the present embodiment, the monitor-specific reference profile includes data representative of the tri-stimulus values of the primary color components Red, Green, and Blue. In addition, the monitor-specific reference profile may include data representative of the luminance ramp for the display screen 210, and the digital control settings corresponding to certain color temperatures. Also stored within the monitor-specific reference profile are the luminance ratios determined at step 935. The reference profile may also includes a table that correlates the voltage settings of the lamps with color temperature, brightness, etc. The format in which the monitor-specific reference profile may be stored is arbitrary. For example, the monitor-specific reference profile may be stored in a manufacturer's proprietary format, or in the International Color Consortium (I.C.C.) profile format.

At step 950, firmware-specific information, such as the version number and format of the reference profile, are appended to the monitor-specific reference profile. According to the present embodiment, the firmware-specific information may be accessed by a host computer system such that the host computer system may determine the reference profile's status and storage format. The firmware-specific information, in one embodiment, is primarily used for error-checking purposes.

At step 960, the monitor-specific reference profile is stored in a memory device, such as memory device 595, within flat panel LCD monitor 216. In one embodiment of the present invention, VESA EDID information and the monitor-specific reference profile are stored within the same physical memory device 595. Thus, in order to streamline the manufacturing process, VESA EDID information and the monitor-specific reference profile may be stored in the same memory device 595 during the same burn-in process. Thereafter, the process ends.

Method and System for Updating the Colorimetric Reference Profile of the LCD Monitor Accordimg to the Present Invention As the lamps of the flat panel LCD monitor 216 (e.g., lamps 132 and 136) age, the chromaticity of each lamp pair (e.g., the ratio of and the emission color from the primary phosphors) generally remains stable. Nonetheless, the peak relative luminance of the lamp pairs may change because each pair may degrade at a different rate. This imbalance may cause a shift in the color characteristics of the LCD monitor 216. Thus, the colorimetric profile would become less and less accurate with respect to the monitor's "true" color outputs. Therefore, in order to maintain an accurate color output and to provide meaningful color data to the user, it may be necessary to update the reference profile of the LCD monitor 216 during its service life. One way of performing the update is to send the monitor 216 back to the factory and go through process 800 again. That solution, however, is very inconvenient to users and is not very practical. Further, process 800 requires the use of expensive equipment and also expertise in color-calibration. Therefore, it is a goal of the present invention to provide a method of updating the color reference profile of the LCD monitor 216 that is convenient to users and that is cost effective.

FIG. 10A is a block diagram illustrating a system 1000 for updating the reference profile of the flat panel LCD monitor 216 during its service life in accordance with the present invention. As illustrated, the system 1000 of the present invention includes computer system 10, flat panel LCD monitor 216 with display screen 210, and a gamma sensor 1010. System control logic 590 is also illustrated.

In one embodiment of the present invention, gamma sensor 1010 may be an inexpensive luminance meter. FIGS. 10B illustrates a exploded view of an exemplary gamma sensor 1010. As illustrated, gamma sensor 1010 includes a housing 1042 for containing light sensor 1040, a shroud 1030, and a cable 1044 for transmitting signals from the light sensor 1040 to a three-conductor plug 1046, which is configured for plugging into a jack (not shown) of monitor 216. Preferably, shroud 1030 is made of a soft rubber foam material for providing a light tight environment without causing significant "bowing" in the flat panel display screen. The housing 1042 is attached to a J-shaped hook 1048 that is configured for mounting onto a top edge of a flat panel LCD monitor.

With reference again to FIG. 10A, computer system is coupled to flat panel LCD monitor 216 for providing video data and control signals. As discussed above, video data may be transmitted via a dual channel LVDS data bus, and control signals may be transmitted via an $I^2C$ interface (or USB bus) running in parallel with the dual channel LVDS data bus.

With reference still to FIG. 10A, during a color reference profile update process of the present invention, the computer system transmits video data corresponding to a plurality of monochromatic windows of known primary colors (e.g., R, G and B) to the flat panel LCD monitor 216 to be displayed. In the present embodiment, each image is displayed at four different combinations of relative light-source intensity levels within window 1020. Particularly, in one embodiment, each image is displayed with the "red" and "blue" lamps set at relative intensity levels shown in Table 1 above.

The gamma sensor 1010 then measures the brightness of the images as they are displayed. The MCU 593 (FIG. 6) receives the readings from the gamma sensor 1010 and translates them into luminance values. The luminance values may then be stored within a memory (e.g., memory 595) or within host computer 10. It should be appreciated that, in the present embodiment, the gamma sensor 1010 is controlled by computer system such that capturing of the chromatic characteristics can be performed synchronously with the displaying of the monochromatic windows and the adjusting of the color temperature.

In one embodiment of the invention, after the luminance measurements are recorded, calculations are then performed to determine the amount of degradation for each lamp that has occurred since the LCD monitor 216 was initially calibrated. The degradation data is then used in determining an updated colorimetric reference profile for the LCD monitor 216.

According to the present embodiment, the updated colorimeteric reference profile may be stored within a memory device (e.g., memory device 595) within monitor 216. Alternatively, the updated colorimeteric reference profile may be stored within host computer system 10.

FIG. 11 is a flow diagram illustrating a process 1100 for updating a monitor-specific reference profile for a flat panel LCD monitor during its service life in accordance with the present invention. It should be appreciated that the process 1100 as illustrated in FIG. 11 may be carried out at any point during the monitor's service life such that a precise and accurate colorimetric reference profile can be maintained.

As illustrated, at step 1110, a flat panel LCD monitor 216 is turned on, and warmed up for several minutes. According to the present invention, the chromatic characteristics of a display screen of a flat panel LCD monitor 216 are somewhat unstable during the first few minutes of operation, and, therefore, monitor 216 is preferably warmed-up for several minutes before chromatic characteristics are measured.

Thereafter, a series of monochromatic windows having known primary colors are displayed on the display screen 210 of the flat panel LCD monitor 216. Particularly, in the present embodiment, the images are displayed with the "red" lamps 132 and "blue" lamps 136 set at the four relative intensity levels as shown in Table 1 above. Particularly, at step 1115, a monochromatic window with pixel values corresponding to pure white (e.g., RGB full on) is displayed at the four different relative light-source intensity levels listed above in Table 1. The luminance values are measured by a gamma sensor (e.g., sensor 1010) and recorded.

Then, at step 1120, a red image (e.g., R-pixels full on, G-pixels and B-pixels full off) is displayed at the relative light-source intensity levels as shown in Table 2. The luminance values for each image are measured by a gamma sensor (e.g., sensor 1010) and recorded.

At step 1125, a green image (e.g., G-pixels full on, R-pixels and B-pixels full off) is displayed at the relative light-source intensity levels as shown in Table 2. The luminance values for each image are measured by a gamma sensor (e.g., sensor 1010) and recorded.

At step 1130, a blue image (e.g., B-pixels full on, R-pixels and G-pixels full off) is displayed at the four light source intensity levels as shown in Table 2. The luminance values for each image are measured by a gamma sensor (e.g., sensor 1010) and recorded.

According to the present embodiment, the luminance values of the three primary colors and white are used in process 1100. However, it should be appreciated that a collection of other various shades of other colors and many other combinations of the intensity levels may also be used to achieve the goals of the present invention as long as the same colors are used in the original calibration process.

At step 1135 of FIG. 11, the measured luminance values are used for determining luminance ratios of the lamps at various brightness levels. In the present embodiment, the relative luminance contributions of each lamp pair (or lamp) are determined by using the maximum brightness setting (e.g., setting 1 of Table 1) as a reference point, and by expressing the luminance values at other brightness settings (e.g., settings 2, 3 and 4) as ratios thereof. If the luminance of the lamps (or lamp) has degraded, then these currently determined ratios would differ from the luminance ratios determined at the factory (e.g., the luminance ratios determined at step 935 of FIG. 9). The luminance ratios can also be used for estimating the absolute luminance values of the lamps provided the initial absolute brightness values of the display are recorded.

At step 1140, the luminance ratios determined at step 1135 are stored in a memory device (e.g., EDID memory) within the flat panel LCD monitor, or within the host computer, for constructing a table that correlates the voltage settings of the lamps, the brightness of the display, the color temperature of the display, etc.

At step 1145, an updated reference profile for the LCD monitor including the table constructed at step 1141 is stored within the EDID memory device of the flat panel LCD monitor. In one embodiment, the updated reference profile replaces the previously stored reference profile, and is used as a reference point in subsequent calibrations and adjustment of the LCD monitor. However, it should be noted that, the nascent characteristics of the display (e.g., tri-stimulus values of each lamp, etc.) stored within the EDID memory device are not replaced.

Thereafter, the profile updating process 1100 ends. The updated reference profile may then be used for recalibrating the LCD monitor to compensate for the loss of brightness caused by lamp degradation.

The present invention, a method of and system for updating the colorimetric reference profile for a flat panel LCD monitor has thus been disclosed. In priort art flat panel displays, the white point of the display cannot be accurately determined without using expensive colorimeters due to lamp degradation. In order to determine the color temperature accurately without using expensive calorimeters and in spite of lamp degradation, the method of the present embodiment determines the change in relative contribution of each pair of lamps over time. That is, the method of the present embodiment measures the luminance values of the display over time as the display ages using an inexpensive gamma sensor, and recalcuates the luminance ratios based on the new luminance values. The recalculated ratios are then compared to the initial ratios to determine the extent to which the lamps have degraded. A close approximate of the absolute luminance values of the lamp pairs can also be determined. When these values are known, the white point of the display can be accurately calculated.

While the present invention has been described in particular embodiments, it should be appreciated that the present invention should not be construed as limited by such embodiments, but should be construed according to the below claims.

What is claimed is:

1. A method for determining a white balance point for a flat panel liquid crystal display, said display having a first light source having a first color temperature and a second light source having a second color temperature, said method comprising the steps of:

a) displaying a monochromatic image on said flat panel display at a first lamp brightness setting and determining a first relative luminance value thereof;

b) displaying said monochromatic image on said flat panel display at a second lamp brightness setting and determining a second relative luminance value thereof;

c) calculating a current luminance ratio from said first luminance value and said second luminance; and d) comparing said current luminance ratio and a predetermined initial luminance of said flat panel display to determine an updated calorimetric profile that accurately represents effects of luminance degradation of said first light source and said second light source.

2. A method as recited in claim 1 wherein said predetermined initial luminance ratio is stored within a memory device contained within said flat panel display.

3. A method as recited in claim 1 wherein said step (a) comprises the step of determining said first relative luminance value with a gamma sensor.

4. A method as recited in claim 3 wherein said step (b) comprises the step of determining said second relative luminance value with said gamma sensor.

5. A method as recited in claim 3 further comprising the step of storing an updated colorimetric reference profile within a memory device located within said flat panel display wherein said updated colorimetric reference profile includes a said current luminance ratio.

6. A method as recited in claim 1 wherein said step (a) comprises the step of displaying said monochromatic window when said first light source is set at a first maximum brightness level and when said second light source is set at a second maximum brightness level.

7. A method as recited in claim 1 wherein said step (b) comprises the step of displaying said monochromatic window when said first light source is set at a first minimum brightness level and when said second light source is set at a second minimum brightness level.

8. A system for accurately determining a white balance point for a flat panel display using gamma sensors, the flat panel display including a first light source having a first color temperature and a second light source having a second color temperature, said system comprising:

means for displaying a monochromatic window on said flat panel display at a first lamp brightness setting;

means for displaying said monochromatic window on said flat panel display at a second lamp brightness setting;

means for determining a first luminance value of said display at said first lamp brightness setting and for determining a second luminance value of said display at said second lamp brightness setting;

means for calculating a current luminance ratio of said display from said first luminance value and said second luminance value; and means for comparing said current luminance ratio and a pre-determined initial luminance ratio of said flat panel display to determine an updated colorimetric profile that accurately represents effects of luminance degradation of said first light source and said second light source.

9. A system as recited in claim 8 wherein said flat panel monitor further comprises:

a liquid crystal display screen and wherein said first and second light sources are positioned to illuminate said liquid crystal display screen with light having a net color temperature that is dependent on an intensity of said first light source and an intensity of said second light source;

a white-balance adjustment control input for receiving a white-balance adjustment control signal from said host computer;

a controller circuit responsive to said white-balance adjustment control signal for adjusting relative brightness levels of said light sources to alter said net color temperature of said liquid crystal display screen.

10. A system as recited in claim 8 wherein flat panel monitor further comprises a memory device that stores said pre-determined initial luminance ratio.

11. A system as recited in claim 10 further comprising means for storing said updated colorimetric reference profile within said memory device.

12. A system as recited in claim 11 wherein said updated colorimetric reference profile comprises a table that correlates between a plurality of voltage settings of said first light source and said second light source and color temperature displayed by said flat panel monitor at said plurality of voltage settings.

13. A method for determining a white balance point for a flat panel liquid crystal display using gamma sensor, the flat panel liquid crystal display including a first light source having a first color temperature and a second light source having a second temperature, said method comprising the steps of:

displaying a monochromic window when said first light source is set at a first maximum brightness and when said second light source is set at a second maximum brightness level;

measuring a first luminance value of said flat panel display with the gamma sensor, wherein said gamma sensor is a single element photometer reading the brightness of each primary color;

displaying said monochromic window when said first light source is set at a first minimum brightness level and when said second light source is set at said second minimum brightness level;

measuring a second luminance of said flat panel display with said gamma sensor;

calculating a current luminance ration on said first luminance value and said second luminance value;

accessing chromaticity data of said first light source and said second light source wherein said chromaticity data includes an initial ration; and comparing said current luminance ration and said initial luminance ratio to determine an updated calorimetric profile that accurately represents effect of luminance degradation of said first light source and said second light source.

14. A method as recited in claim 13 wherein said chromaticity data is stored within a memory device contained within said flat panel display.

15. A method as recited in claim 14 further comprising the step of storing said updated colorimetric reference profile within said memory device.

16. A method as recited in claim 1 further comprises the step of constructing a table that correlates between a plurality of voltage settings of said first light source and said second light source and color temperature displayed by said flat panel display at said plurality of voltage settings.

17. A method as described in claim 16 wherein said table is stored as part of said updated calorimetric reference profile of said flat panel display.

* * * * *